United States Patent [19]

Thompson

[11] Patent Number: 4,658,450

[45] Date of Patent: Apr. 21, 1987

[54] MULTI-POSITION BED

[75] Inventor: Martin S. Thompson, Bickley, England

[73] Assignee: Egerton Hospital Equipment Limited, Kent, England

[21] Appl. No.: 797,804

[22] Filed: Nov. 13, 1985

[30] Foreign Application Priority Data

Nov. 20, 1984 [GB] United Kingdom ..... 8429324

[51] Int. Cl.[4] ..... A61G 7/06

[52] U.S. Cl. ..... 5/61; 5/62; 5/66; 5/90

[58] Field of Search ..... 5/60–68, 5/90

[56] References Cited

U.S. PATENT DOCUMENTS

| | | | |
|---|---|---|---|
| 577,303 | 2/1897 | Holmes | 5/90 |
| 684,218 | 10/1901 | Gavan | 5/61 |
| 954,082 | 4/1910 | Gavan | 5/61 |
| 1,677,218 | 7/1928 | Shand | 5/61 |
| 2,284,470 | 5/1942 | Comper et al. | 5/66 |
| 2,522,018 | 9/1950 | Blackman | 5/61 |
| 3,200,416 | 8/1965 | Warrick | 5/67 |
| 4,084,274 | 4/1978 | Willis et al. | 5/66 |
| 4,375,706 | 3/1983 | Finnhult | 5/61 |
| 4,425,673 | 1/1984 | Werner | 5/63 |

*Primary Examiner*—Gary L. Smith
*Assistant Examiner*—Michael F. Trettel
*Attorney, Agent, or Firm*—Cushman, Darby & Cushman

[57] ABSTRACT

This disclosure relates to a multi-position bed such as is used in hospitals and for persons who by reason of physical disability of age are unable to turn or move themselves in bed. As shown in FIG. 4 the bed comprises a base frame 1 supported on casters and having a pair of pivoted angled lifting arms 2. One of the pair of lifting arms is pivoted inturn to an interlink pivoted to a pivot bracket 4. The other lifting arm 2 is pivoted directly to a second pivot. The pivot brackets 4 and 5 act as the pivot supports for the center section 6 of a mattress platform which also comprises two side sections 7. The side sections 7 are not hinged directly to the center section but simply have interengaging features in the form of side frame registers 11. When the bed is used as a turning bed the interengaging features 11 disengage. The side sections 7 are carried by pairs of links 8 and 9 which join the pivot brackets 4 to the side sections 7 at points underneath the side sections. These side sections are also connected by side frame pivot arms 13 to an end pivot frame 12, at each end of the bed, the pivot frame 12 being rigidly connected to the center bed section 6. The movement of the bottom links 8 is restricted, in a downward direction, by bottom link stops 10. The links 8,9 may be disconnected and the side sections 7 connected rigidly to the center section 6 so that the mattress platform can be caused to tilt bodily in a lateral sense.

13 Claims, 14 Drawing Figures

MULTI-POSITION BED

This invention relates to a multi-position bed such as is used in hospitals and for persons who by reason of physical disability or age are unable to turn or move themselves in bed. Moving such persons manually at frequent intervals is a time consuming and physically tiring activity for the nurse and hence multi position beds have been produced which have the facility for turning a patient and also for tilting in various directions.

An object of the present invention is to provide a multi position bed which has many different functions but is compact and simple to operate.

According to the invention a multi-position bed comprises a base frame carrying a mattress platform which is pivoted at its ends, on pivot brackets carried on a base frame, for lateral tilting, the platform comprising a centre section and two side sections, the side sections being connected at their ends by links to end pivot frames on the centre section and being connected at intermediate points through pairs of links to a pivot bracket whereby lateral tilting of the centre section in either direction causes a side section to tilt in the other direction to produce a turning effect on a patient.

Preferably the side sections and centre sections have interengaging features along their adjacent edges which only engage when the centre section is in its non (laterally) tilted position, but automatically disengage when lateral tilting of the centre section takes place. Preferably the pairs of links are easily disconnectable and one link of each pair may then be used as a strut to rigidify the connection between each side section and the centre section so that when the centre section is laterally tilted it carries with it both of the side sections so that all three sections remain planar and tilt together.

Preferably the lateral tilting movement of the centre section is produced by a screw and nut mechanism. The screw may be driven by an electric motor carried on the underside of the centre section and the nut may be mounted on one of the pivot brackets.

From another aspect a multi position bed comprises a base frame on which is pivoted a mattress platform for lateral tilting movement, the mattress platform comprising a cross section and two side sections, the centre section being pivoted on pivot brackets below the mattress platform and the side sections being connected to the pivot bracket by links, the arrangement being such that with the links in place when the centre section is pivoted laterally in either direction the side section separates and pivots in the other direction so as to produce a turning movement of the patient, the links being disconnectable and the side and centre sections being capable of being rigidified so that when the centre section is tilted the bed frame as a whole tilts laterally without any separation of the side sections.

Preferably at one end of the bed the centre and side sections both have pivoted end portions which may be raised together to provide an uplifting backrest.

The side sections and centre sections are preferably separately pivoted but so arranged that, when the centre section is lifted, laterally projecting lifting plates on the centre section will engage corresponding laterally projecting lifting plates on the side sections so that all three sections lift together. When the bed is used in its turning mode the side sections separate from the centre section because the lifting plates are not attached to each other.

Preferably the pivot brackets on which the centre section is pivoted are themselves carried by lifting arms at each end of the bed, the arms being pivoted on the mattress platform. These arms may be operated by screw jacks in turn operated by electric motors so that the mattress platform may be raised and lowered bodily or maybe tilted longitudinally at will.

Preferably the lifting arms are operable by nut and screw mechanisms, there being two such mechanisms each operated by an electric motor so as to provide independent movement of the arms to enable the bed to be tilted.

The movement of these arms may be assisted by gas struts so as to relieve the load on the motors and the gas struts may be located longitudinally on or beneath the base frame.

The base frame may be carried on caster wheels in conventional manner and the caster wheels may have braking facilities.

The centre section of the mattress platform may have a hinged flap, for toilet purposes, and the flap may have combined hinges and catches at each side so that removal of the catches at one side enables the flap to be pivoted about its other side and vice versa. This enables the flap to be opened from either side of the bed at will.

Figure 1:
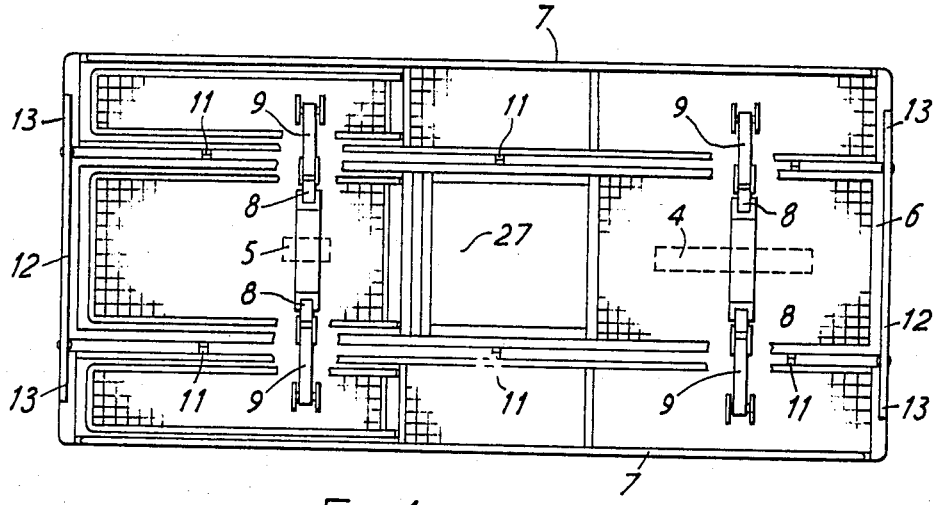
FIG. 1 is a plan view of a bed incorporating the present invention showing bed centre and side sections, cut away to show a linkage system.
Figure 2:
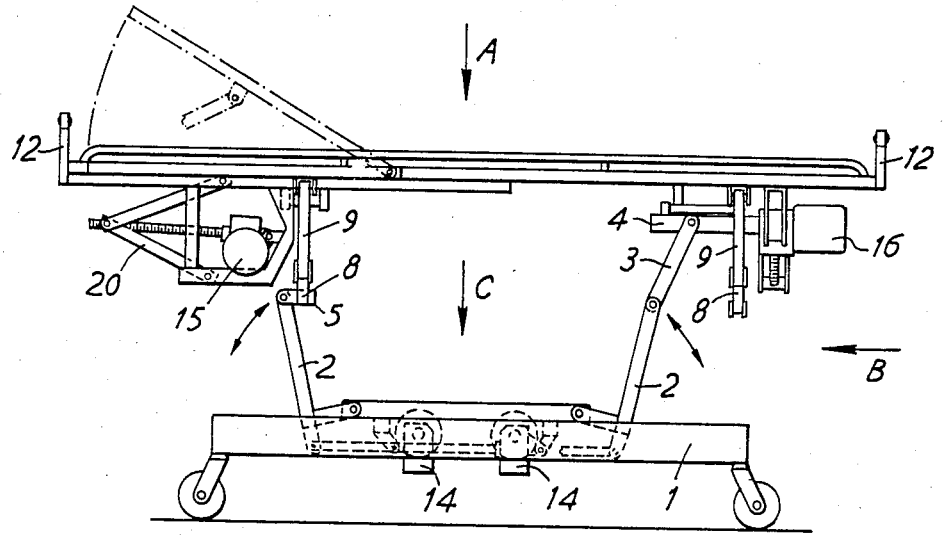
FIG. 2 is a side elevation of the bed showing lifting motors, backrest lifting drive, and bed turning drive.

As shown in FIGS. 1 to 5 of the drawings the bed comprises a base frame 1 supported on casters and having a pair of pivoted angled lifting arms 2. One of the pair of lifting arms is pivoted in turn to an interlink 3 pivoted to a pivot bracket 4. The other lifting arm 2 is pivoted directly to a pivot 5.

The pivot brackets 4 and 5 (best seen in FIGS. 3 and 4) act as the pivot supports for the centre section 6 of a mattress platform which is (as seen best in FIG. 1) also comprises two side sections 7. The side sections 7 are not higned directly to the centre section but simply have interengaging features in the form of side frame registers 11 which may be in the form of pins and slots which simply act to steady and hold the centre and side sections engaged in the position shown in FIG. 3. It should be noted that when the bed is used as a turning bed the interengaging features 11 disengage as shown in FIG. 4.

Figure 3:
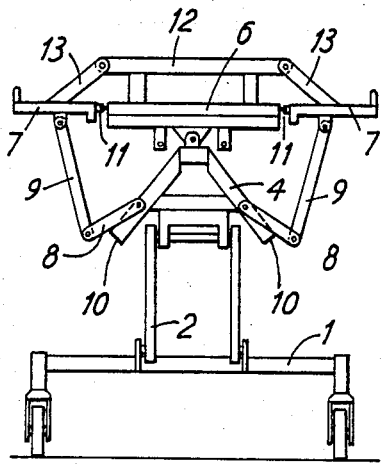
FIG. 3 is a view in direction of Arrow B with the bed horizontal, showing linkage system between the bed centre section and the bed side sections.
Figure 4:
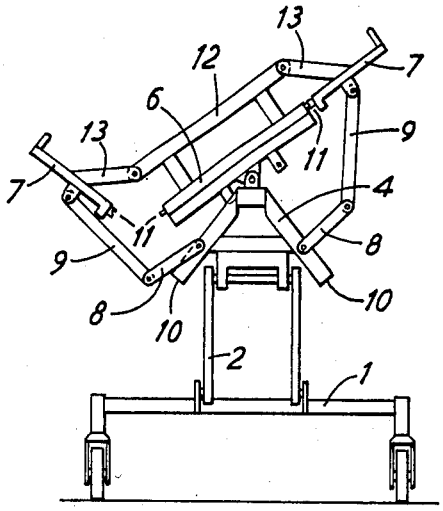
FIG. 4 is a view in direction of Arrow B with the bed turned to an angle of 35°, showing positions of the bed side sections and the linkage system.

The side sections 7 are carried by pairs of links 8 and 9 which join the pivot brackets 4 and 5 to the side sections 7 at points underneath the side sections and roughly midway across the side sections (see FIGS. 1 and 3).

These side sections are also connected by side frame piovt arms 13 to an end pivot frame 12, at each end of the bed, the pivot frame 12 being rigidly connected to the centre bed section 6. The movement of the bottom links 8 is restricted, in a downward direction, by bottom link stops 10.

Figure 11:
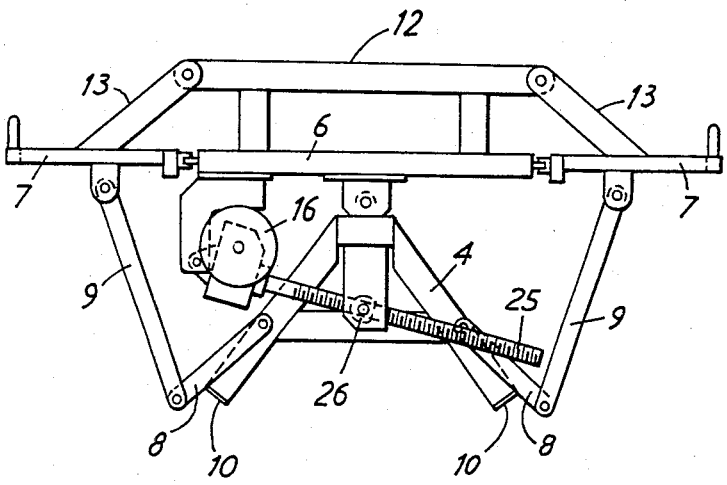
FIG. 11 is a view in direction of Arrow B with the bed horizontal, showing a turn drive motor, actuating screw, and position of linkage system.
Figure 12:
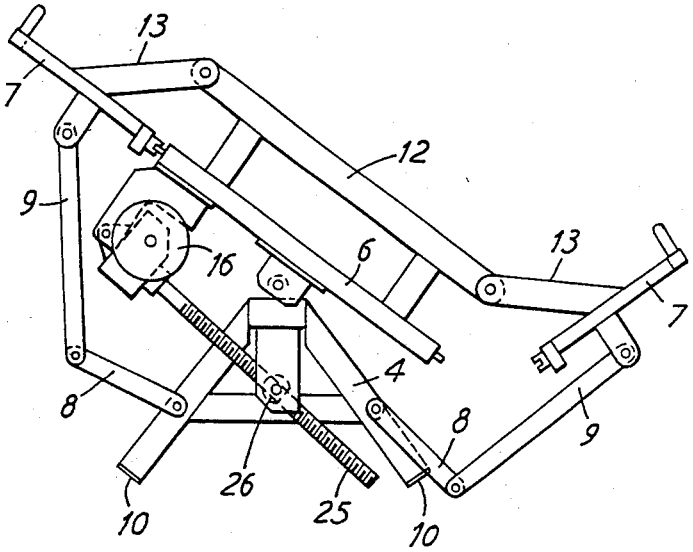
FIG. 12 is a view in direction of Arrow B with the bed turned to an angle of 35°, showing position of the turn drive motor, actuating screw, and linkage system.

In FIGS. 11 and 12 the turning movement of the bed i.e. the movement which enables the patient to be turned when on the bed, can be seen more explicitly. In FIG. 11 is shown an electric turning drive motor 16 which drives a turning actuator screw 25 engaged with a turning trunion nut 26 pivoted on the pivot bracket 4.

Operation of the motor in one direction will cause the centre section 6 to turn about its pivot producing lateral tilting action of the centre section and this will cause the side section 7 to move from the position shown in the FIG. 11 to that shown in FIG. 12. It will be seen that the interengaging features have been separated and the side section is now tilted at an angle opposite to that at which the centre section is retained in this position by the links 8 and 9 and by the links 12 and 13.

Operations of the motor 16 in the opposite direction will cause tilting of the frame 6 in the opposite direction and will cause the other side section to separate from the centre section thus producing a turning effect on the patient in the opposite direction.

Figure 5:
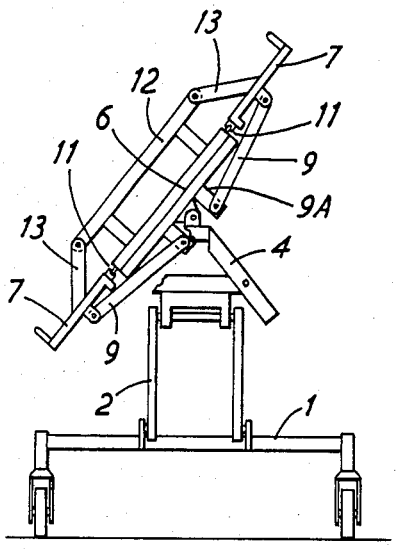
FIG. 5 is a view in direction of Arrow B with the bed turned to an angle of 50°, showing positions of the bed side sections, and attachment of top links to lock the side sections to the bed centre section.

Reverting to FIGS. 4 and 5, if a pure tilting movement of the mattress platform as a whole is required then each link 8 may be removed and each link 9 may be connected as shown in FIG. 5 by means of a pin to a bracket 9A. This rigidifies the connection between the side sections 7 and the centre section 6 so that when the motor 16 is operated the mattress platform comprising centre section 6 and two side sections 7 will tilt naturally as a whole.

Figure 6:
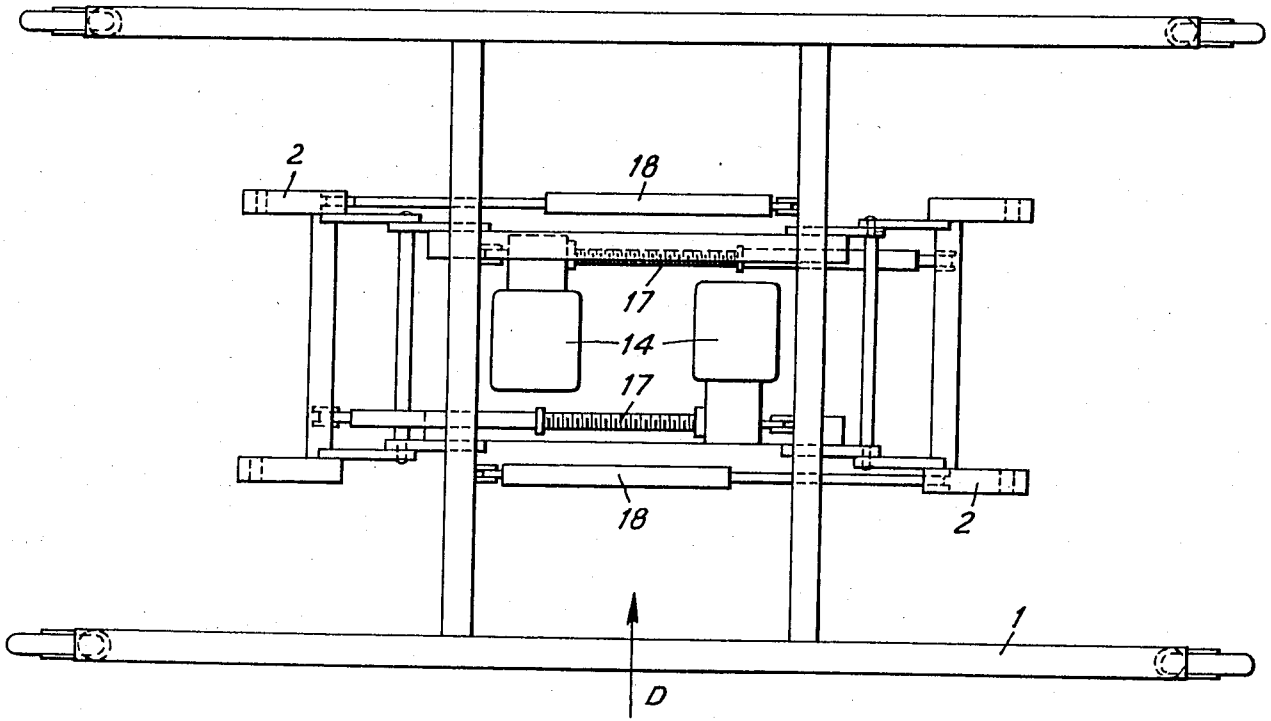
FIG. 6 is a plan view of a base assembly in the direction of Arrow C, showing lifting motors and actuating screws, together with gas filled struts.
Figure 7:
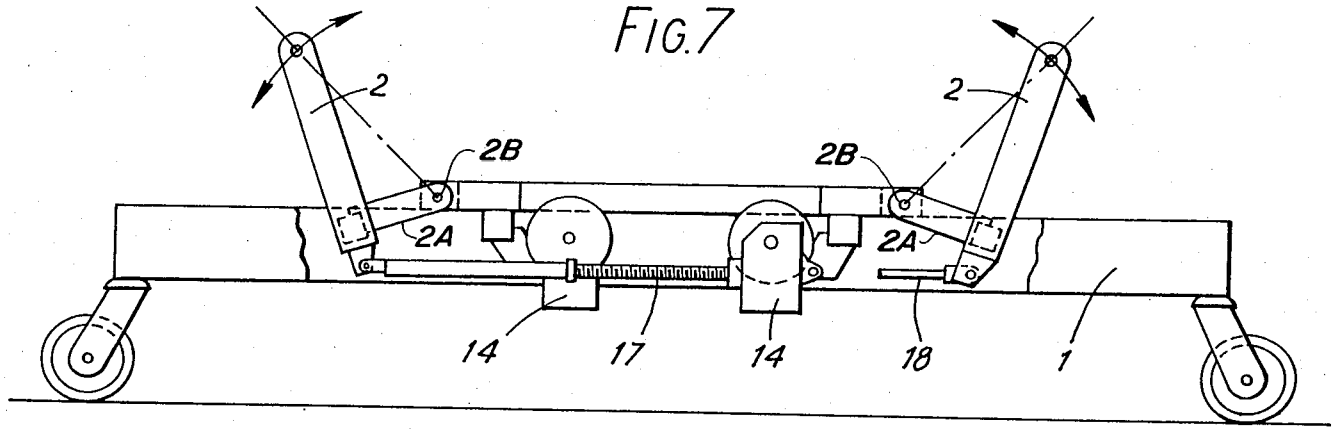
FIG. 7 is a side elevation of the base assembly in direction of Arrow D, cut away to show lifting motors and actuating screws together with the position of the gas filled struts.

The raising and lowering of the mattress platform and longitudinal tilting of the mattress platform is effected by the lifting arms 2 as shown in enlarged detail in FIGS. 6 and 7. Each link 2 is rigidly connected to an arm 2A pivoted at 2B. Each link 2 is moved by an electric motor 14 driving a lifting drive actuator screw 17. The action is assisted by a pair of gas struts 18 which relieve the stress in the motors and screws.

If both motors are operated simultaneously to turn the lifting arms in opposite directions the mattress platform will be bodily raised or lowered.

If the motors 14 are operated so as to turn the arms 2 in the same direction the mattress platform will longitudinally tilt in one direction or the other.

Alternatively if one of the motors 14 is operated so as to turn one of the arms 2 whilst the other arm 2 remains stationary, the mattress platform will longitudinally tilt in one direction or the other.

Figure 10:
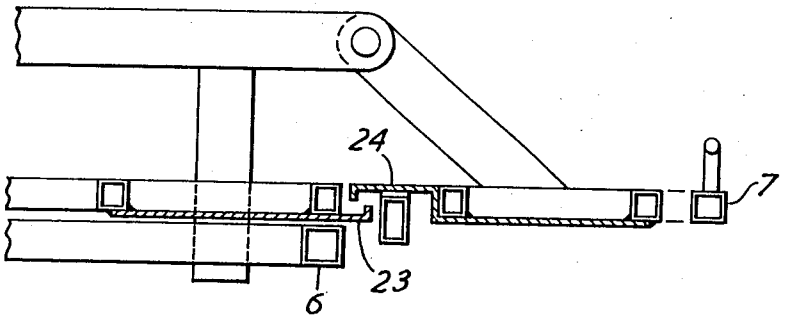
FIG. 10 is a section of 'E'–'E' showing lifting plates attached to the centre section and side sections of the hinged backrest.
Figure 8:
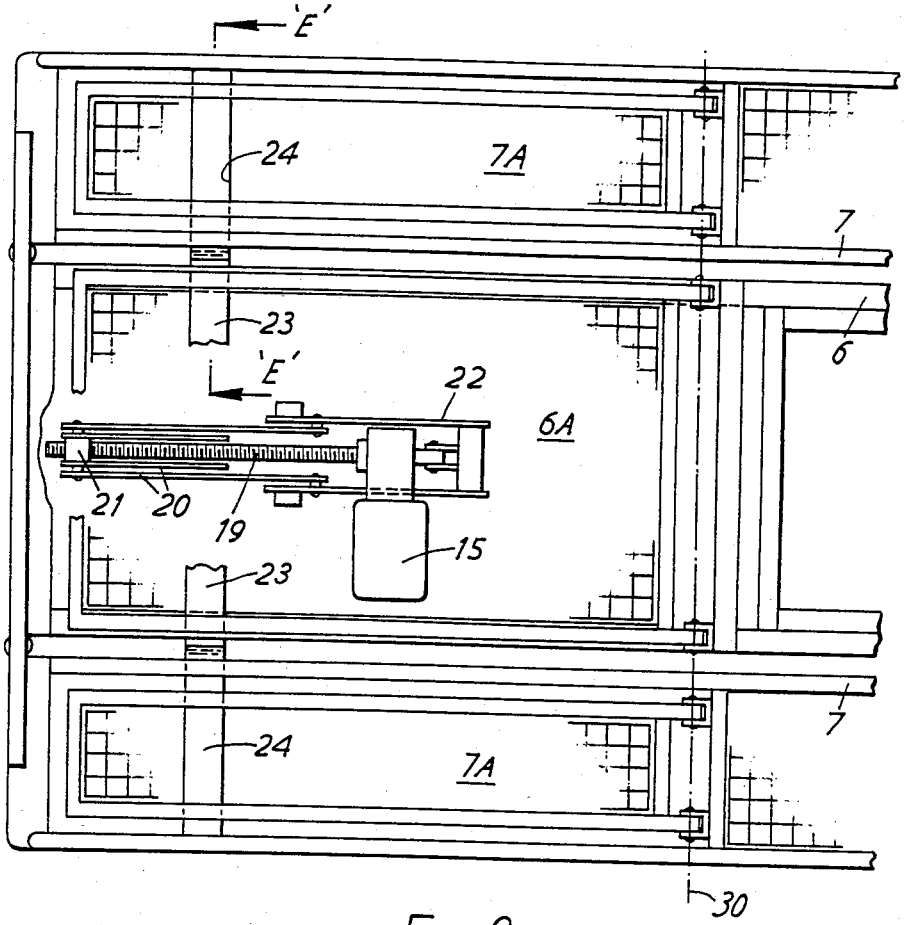
FIG. 8 is a plan view of the bed showing hinged backrest sections, cut away to show the backrest drive motor, actuating screw, and scissor type lifting linkage.
Figure 9:
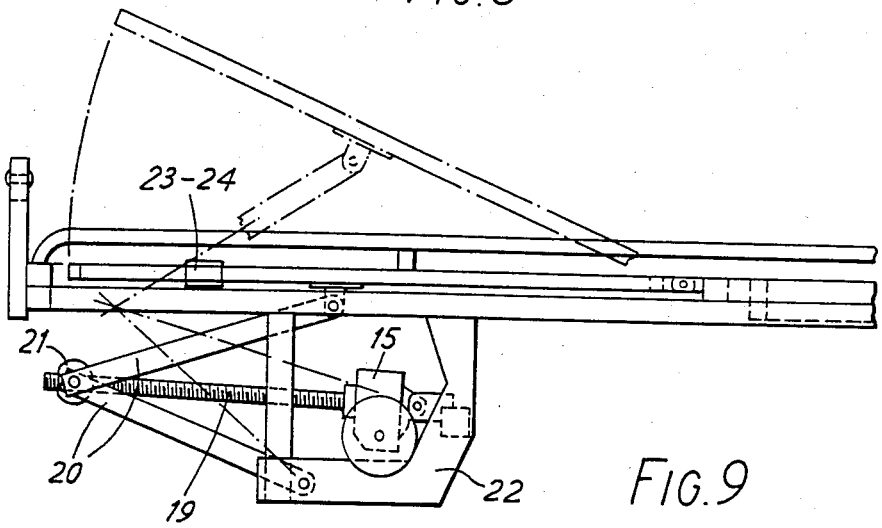
FIG. 9 is a side elevation of the hinged backrest showing the backrest drive motor, actuating screw, and scissor type lifting linkage.

As shown in FIGS. 8, 9 and 10 there is provision for raising a backrest. The backrest consists of the end portions 7A of the two side sections and the end portions 6A of the centre section of the mattress platform, all of these end portions being pivoted on pivot line 30. The centre section 6A can be raised to the position shown in FIG. 9 by means of a backrest drive motor 15 supported in a drive bracket 22 attached to the underside of the mattress platform. The drive motor 15, through a backrest actuator screw 19 and trunion nut 21, operates a pair of lifting links 20 which lift the centre section 6A to the position shown in FIG. 9 or any intermediate position.

As the centre section lifts it carries with it the two side sections. This is achieved by a pair of plates 23 and 24 which are arranged as shown in FIG. 10 so that the lower plate 23 on the centre sections 6A engages beneath the upper plate 24 on the section 7A. This method of ensuring that the three sections are raised and lowered together does not interfere with the turning action of the bed when the side sections and centre sections of the bed separate.

Figure 13:
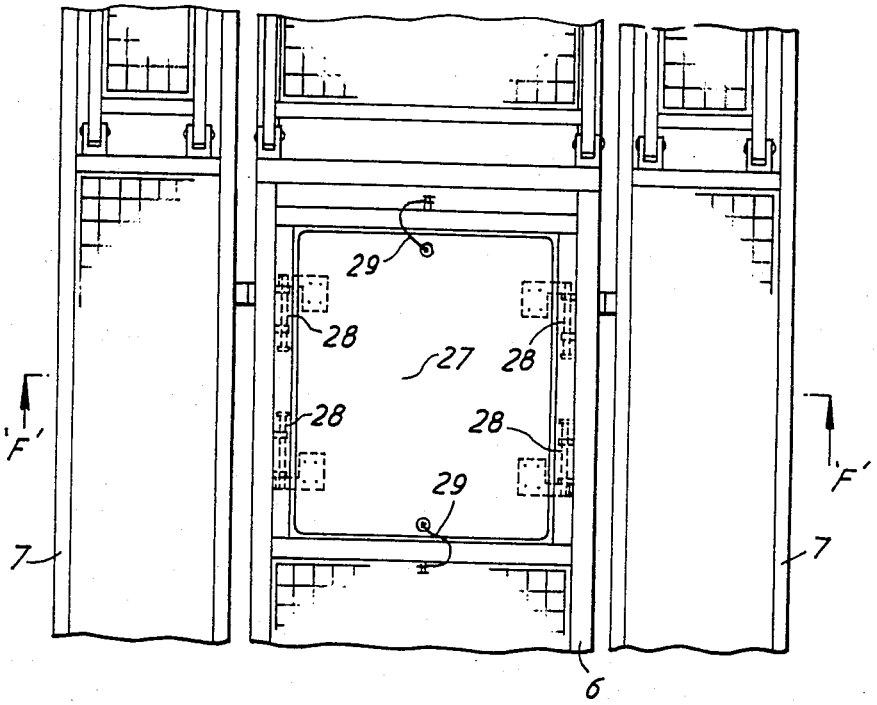
FIG. 13 is a plan view of bed in the direction of Arrow A, showing hinged flap which allows bed pan to be positioned from the underside of the bed frame.
Figure 14:
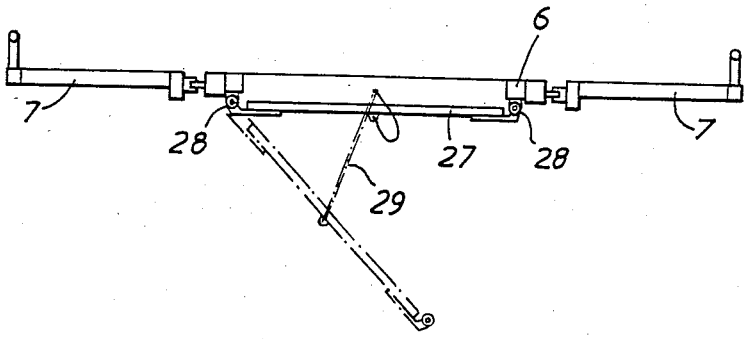
FIG. 14 is a section on 'F'-'F' showing the hinged flap which can be hinged down from either side of the bed.

Turning now to FIGS. 13 and 14, a hinge flap 27 is provided in the centre of the centre section 6 of the mattress platform. At each side of the flap 27 are pairs of quick release hinge/locating pins. If the pins 28 on one side of the flap are released the other pins 28 on the other side of the flap act as a hinge and the flap can be lowered. With this facility the flap can be lowered from either side of the bed. A flap of this kind is used for toilet purposes etc. The movement of the flap is limited by a stop cable 29 as shown in FIG. 14.

What is claimed is:

1. A multi-position bed comprising a base 1 frame carrying a mattress platform, the mattress platform being pivoted at its ends, on pivot brackets, for lateral tilting about an axis located below the platform, the pivot brackets being connected to the base frame by lifting arms, the mattress platform comprising a centre section and two side sections, the side sections being connected at their ends by links to end pivot frames on the centre section of other links to a pivot bracket whereby lateral tilting of the centre section and being connected at intermediate points through pairs in either direction causes a side section to tilt in a conrolled manner in the other direction to produce a turning effect on a patient, each of said pairs of other links comprising two links connected in series.

2. A multi-position bed according to claim 1 and in which the side sections and centre sections have interengaging features along their adjacent edges which only engage when the centre section is in its non (laterally) tilted position, but automatically disengage when lateral tilting of the centre section takes place.

3. A multi-position bed according to claim 1 and in which the pairs of other links are easily disconnectable so that one link of each pair may be used as a strut to rigidify the connection between each side section and the centre section so that when the centre section is laterally tilted it carries with it both of the side sections so that all three sections remain planar and tilt together.

4. A multi-position bed according to claim 1 and in which the lateral tilting movement of the centre section is produced by a screw and nut mechanism.

5. A multi-position bed according to claim 4 and in which the screw is driven by an electric motor carried on the underside of the centre section and the nut may be mounted on one of the pivot brackets.

6. A multi-position bed according to claim 1 and in which, at one end of the bed, the centre and side sections both have pivoted end portions which may be raised together to provide an uplifting backrest.

7. A multi-position bed according to claim 1 and in which the centre section of the mattress platform has a hinged flap, for toilet purposes, and the flap has combined hinges and catches at each side so that removal of the catches at one side enables the flap to be pivoted about its other side and vice versa, thus enabling the flap to be opened from either side of the bed at will.

8. A multi-position bed comprising a base frame on which is pivoted a mattress platform for lateral tilting movement, the mattress platform comprising a centre section and two side sections, the centre section being pivoted on pivot brackets below the mattress platform for lateral tilting and the side sections being connected to the pivot brackets by pairs of links pivotally connected end-to-end, the arrangement being such that with the links in place when the centre section is pivoted laterally in either direction the lowermost side section separates and pivots in the other direction so as to produce a turning movement of the patient, the links of each pair being disconnectable and the side and centre sections being capable of being rigidified by connecting single links between the side sections and mounted to the center section so that when the centre section is tilted the mattress platform as a whole tilts laterally without any separation of the side sections.

9. A multi-position bed according to claim 8 and in which the side sections and centre sections are separately pivoted but so arranged that, when the centre section is lifted, laterally projecting lifting plates on the centre section will engage corresponding laterally projecting lifting plates on the side sections so that all three sections lift together so arranged that when the bed is used in its turning mode the side sections separate from the centre section because the lifting plates are not attached to each other.

10. A multi-position bed according to claim 8 and in which the pivot brackets on which the centre section is pivoted are themselves carried by lifting arms at each end of the bed, the arms being pivoted on the mattress platform.

11. A multi-position bed according to claim 10 and in which the arms are operated by screw jacks in turn operated by electric motors so that the mattress platform may be raised and lowered bodily or may be tilted longitudinally at will.

12. A multi-position bed according to claim 10 and in which the lifting arms are operable by nut and screw mechanisms, there being two such mechanisms each operated by an electric motor so as to provide independent movement of the arms to enable the bed to be tilted.

13. A multi-position bed according to claim 12 and in which the movement of the arms is assisted by gas struts so as to relieve the load on the motors and the gas struts may be located longitudinally on or beneath the base frame.

* * * * *

Disclaimer 4,658,450—*Martin S. Thompson*, Bickley, England. MULTI-POSITION BED. Patent dated Apr. 21, 1987. Disclaimer filed Feb. 25, 1991, by the assignee, Egerton Hospital Equipment Limited.

Hereby enters this disclaimer to claims 1 and 3 of said patent.

[ *Official Gazette June 11, 1991* ]